US010570722B2

(12) United States Patent
Moriarty et al.

(10) Patent No.: US 10,570,722 B2
(45) Date of Patent: Feb. 25, 2020

(54) MEASUREMENT AND CONTROL OF SHOCK AND VIBRATION

(71) Applicant: Schlumberger Technology Corporation, Sugar Land, TX (US)

(72) Inventors: Keith Moriarty, Houston, TX (US); Raphael Gadot, Katy, TX (US); Dale Meek, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 42 days.

(21) Appl. No.: 15/744,102

(22) PCT Filed: Jul. 13, 2016

(86) PCT No.: PCT/US2016/041956
§ 371 (c)(1),
(2) Date: Jan. 12, 2018

(87) PCT Pub. No.: WO2017/011485
PCT Pub. Date: Jan. 19, 2017

(65) Prior Publication Data

US 2018/0202279 A1 Jul. 19, 2018

Related U.S. Application Data

(60) Provisional application No. 62/191,858, filed on Jul. 13, 2015.

(51) Int. Cl.
*E21B 21/08* (2006.01)
*E21B 44/04* (2006.01)
(Continued)

(52) U.S. Cl.
CPC ..... *E21B 44/04* (2013.01); *E21B 4/02* (2013.01); *E21B 21/08* (2013.01);
(Continued)

(58) Field of Classification Search
CPC ..... E21B 44/04; E21B 41/0085; E21B 4/02; E21B 21/08
See application file for complete search history.

(56) References Cited

U.S. PATENT DOCUMENTS 9,863,238 B2 * 1/2018 Miles ..... E21B 47/122
2008/0158006 A1 7/2008 Pisoni et al.
(Continued)

FOREIGN PATENT DOCUMENTS

WO WO2010138718 A1 12/2010

OTHER PUBLICATIONS

International Search Report and Written Opinion issued in International Patent application PCT/US2016/041956, dated Oct. 17, 2016. 13 pages.

*Primary Examiner* — David J Bagnell
*Assistant Examiner* — Brandon M Duck

(57) ABSTRACT

A system for measuring and control of shock and vibration is disclosed. The system may include a bottomhole assembly having a downhole end and an uphole end opposite the downhole end. A drill bit may be located at the downhole end of the bottomhole assembly and a powered rotary steering system may be located in the bottomhole assembly. The system may also include a first drilling mechanics module located in the bottomhole assembly, proximate the powered rotary steering system and the drill bit. The first drilling mechanics module may be coupled in electronic communication to the power rotary steering system. The system may also include a plurality of drilling dynamics measurement units distributed along a length of the bottomhole assembly, between the downhole end and the uphole end. The plurality of drilling dynamics measurement units may be coupled in electronic communication with the first drilling mechanics module.

17 Claims, 3 Drawing Sheets

(51) Int. Cl.

| | |
|---|---|
| ***E21B 47/00*** | (2012.01) |
| ***E21B 4/02*** | (2006.01) |
| ***E21B 47/12*** | (2012.01) |
| ***E21B 41/00*** | (2006.01) |
| *E21B 7/04* | (2006.01) |
| *E21B 45/00* | (2006.01) |
| *E21B 47/024* | (2006.01) |
| *E21B 47/18* | (2012.01) |

(52) U.S. Cl.
CPC ..... *E21B 41/0085* (2013.01); *E21B 47/00* (2013.01); *E21B 47/12* (2013.01); *E21B 7/04* (2013.01); *E21B 45/00* (2013.01); *E21B 47/024* (2013.01); *E21B 47/18* (2013.01)

(56) References Cited

U.S. PATENT DOCUMENTS

| | | | | |
|---|---|---|---|---|
| 2012/0123756 | A1 | 5/2012 | Wang et al. | |
| 2013/0126241 | A1 | 5/2013 | Boone et al. | |
| 2014/0158428 | A1 | 6/2014 | Boone et al. | |
| 2014/0262211 | A1* | 9/2014 | Xu ..... | E21B 23/006 166/179 |

* cited by examiner

MEASUREMENT AND CONTROL OF SHOCK AND VIBRATION

CROSS-REFERENCE TO RELATED APPLICATIONS

The present application claims priority to U.S. Provisional Application 62/191,858, filed Jul. 13, 2015, the entirety of which is incorporated by reference.

FIELD OF THE INVENTION

Some embodiments described herein generally relate to systems and apparatuses that include measuring and controlling shock and vibration. Additional embodiments generally relate to methods of measuring and controlling shock and vibration.

BACKGROUND

In the drilling of oil and gas wells, information regarding the shock and vibration to which the bottomhole assembly and the drillstring may be subjected may be used to aid in controlling the operation of the drilling rig. Shocks and vibrations can lead to premature failure of the drillstring and in particular the systems within the bottomhole assembly. Identification and mediation of undesirable shocks and vibrations may extend the life of a bottomhole assembly and increase drilling rig productivity.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system for measuring and controlling shock and vibration is disclosed. The system may include a bottomhole assembly having a downhole end and an uphole end opposite the downhole end. A drill bit may be located at the downhole end of the bottomhole assembly and a powered rotary steering system may be located in the bottomhole assembly. The system may also include a first drilling mechanics module located in the bottomhole assembly, proximate the powered rotary steering system and the drill bit. The first drilling mechanics module may be coupled in electronic communication to the power rotary steering system. The system may also include a plurality of drilling dynamics measurement units distributed along a length of the bottomhole assembly, between the downhole end and the uphole end. The plurality of drilling dynamics measurement units may be coupled in electronic communication with the first drilling mechanics module.

A method of measuring and controlling shock and vibration is also disclosed. The method may include receiving first measurements of mechanical behavior of a bottomhole assembly from a first drilling mechanics module by a controller located in the bottomhole assembly. The method may also include receiving second measurements of mechanical behavior of a bottomhole assembly from a plurality of drilling dynamics measurement units distributed along a length of the bottomhole assembly and controlling a drill bit located at a downhole end of the bottomhole assembly by the controller via a powered rotary steering system.

BRIEF DESCRIPTION OF THE DRAWINGS

In the drawings, sizes, shapes, and relative positions of elements are not drawn to scale. For example, the shapes of various elements and angles are not drawn to scale, and some of these elements may have been arbitrarily enlarged and positioned to improve drawing legibility.

DETAILED DESCRIPTION

Figure 1:
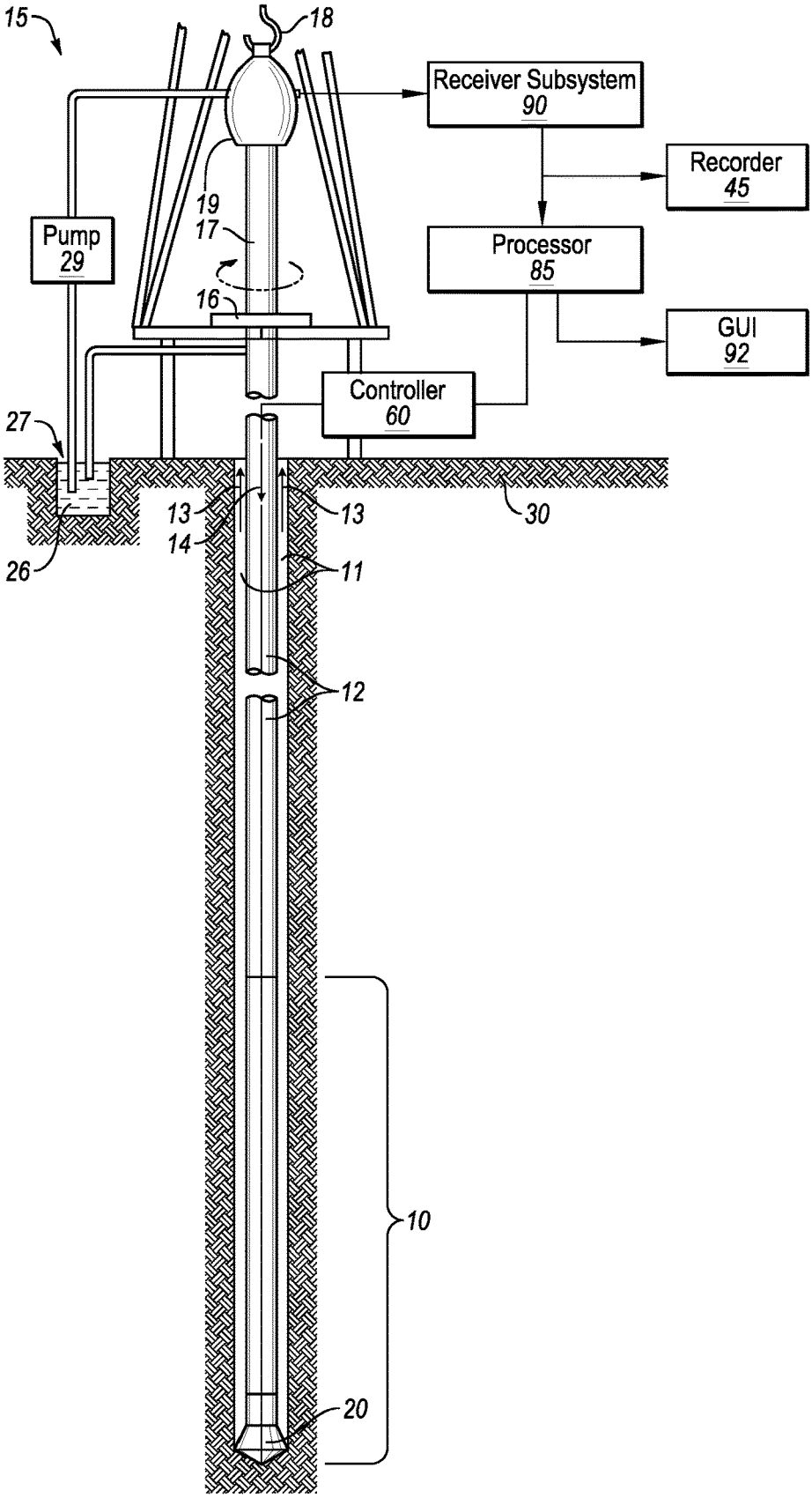
FIG. 1 depicts a drilling rig and drill string according to one or more embodiments disclosed herein.

FIG. 1 illustrates a land-based platform and drilling rig 15 positioned over a wellbore 11, and a drill string 12 for exploring a formation 30. In the illustrated embodiment, the wellbore 11 is formed by rotary drilling. Those of ordinary skill in the art given the benefit of this disclosure will appreciate, however, that the subject matter of this disclosure also finds application in directional drilling applications and is not limited to land-based rigs.

The drill string 12 is rotated by a rotary table 16, energized by means not shown, which engages a kelly 17 at the upper end of the drill string 12. The drill string 12 is suspended from a hook 18, attached to a travelling block (also not shown), through the kelly 17 and a rotary swivel 19 which permits rotation of the drill string 12 relative to the hook 18. Although depicted with a kelly 17 and rotary table 16 in FIG. 1, in some embodiments, the drill string 12 may be rotated using other methods, such as by using a topdrive.

Drilling fluid 26 (also referred to as drilling mud) is stored in a pit 27 formed at the well site. A pump 29 delivers the drilling fluid 26 to the interior of the drill string 12 via a port in the rotary swivel 19, inducing the drilling fluid 26 to flow downwardly through the drill string 12 as indicated by the directional arrow 14. The drilling fluid 26 exits the drill string 12 via ports in a drill bit 20, and then circulates upwardly through the region between the outside of the drill string 12 and the wall of the wellbore 11, called the annulus, as indicated by the direction arrows 13. In this manner, the drilling fluid 26 lubricates the drill bit 20 and carries formation cuttings up to the surface as drilling fluid 26 returns to the pit 27 for recirculation.

The drill string 12 is suspended within the wellbore 11 and includes a bottomhole assembly 10 at its lower connection, or bottom end. The bottomhole assembly 10 may include a drill bit 20 at its lower connection, or bottom end. The bottomhole assembly 10 may also include other systems as shown and described in FIGS. 2-5. The systems may include logging while drilling systems, measurement while drilling systems, stabilizers, rotary steerable systems, mud motors, energy converting systems, energy storage systems, drilling mechanics modules, and other bottomhole assembly systems.

Bottomhole assembly systems may collect data and then transmit the data to a receiver system 90, which can be communicatively coupled to a computer processor 85 and a recorder 45. The computer processor 85 may be coupled to a monitor, which can employ a graphical user interface ("GUI") 92 through which measurements and particular results derived therefrom can be graphically or otherwise presented to the user. The computer processor 85 can also be communicatively coupled to a controller 60. The controller 60 can serve multiple functions, for example, the controller 60, computer processor 85, and GUI 92, may receive and process information from the systems in the bottomhole assembly 10 and then display the processed information on the GUI 92. An operator may then use the controller 60 to adjust the operation of the drilling rig 15. Although depicted at the surface, the controller 60 and computer processor 85 may be configured in any suitable manner. For example, the controller 60 and/or computer processor 85 may be part of the drill string 12. This illustration shows one method of communication from bottomhole assembly to the rig known as "Wired Drill Pipe." Other methods of communication from the bottomhole assembly to surface includes mud pulse or electromagnetic telemetry.

Figure 2:
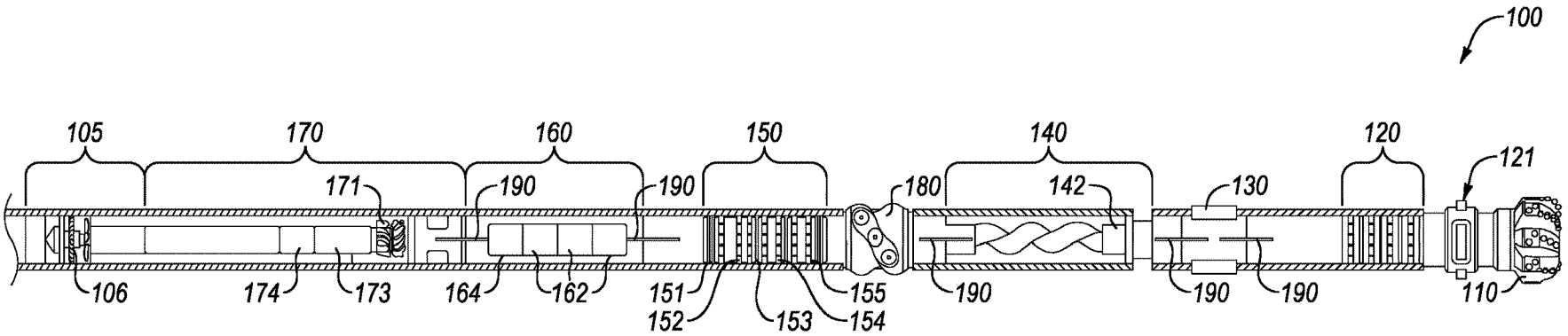
FIG. 2 depicts a bottomhole assembly string according to one or more embodiments disclosed herein.

FIG. 2 depicts an embodiment of a bottomhole assembly 100. The bottomhole assembly 100 may be coupled to the drill string 12 shown in FIG. 1, in place of the bottomhole assembly 10. The bottomhole assembly 100 may include several systems. For example, the bottomhole assembly 100 includes a drill bit 100, a telemetry system 120, a drilling mechanics module 130, a powered rotary steering system 140, a logging while drilling system 150, a power storage system 160, a computing system 170, and an uphole communication system 105. These systems may be within different sections of the bottomhole assembly 100 that are mechanically and electrically coupled together during the bottomhole assembly process. Each system or module within a section of the bottomhole assembly 100 may be electrically coupled together via a multi conductor communication bus 190 that facilitates real time communication between each section of the bottomhole assembly 100.

The bottomhole assembly 100 includes a drill bit 110 at its downhole end. The drill bit 110 is the cutting tool used to bore the wellbore 11. Energy is delivered to the drill bit via the rotary table 16 and the drilling fluid 26.

The rotary table is mechanically linked to the drill bit through the drill string 12, including the drill pipe, which is mechanically coupled to the bottomhole assembly 100. As the rotary table 16 rotates, the rotational energy is transferred through the drill string 12 to the drill bit 110, causing the drill bit 110 to rotate.

The drilling fluid 26 also transmits energy to the drill bit 110. The hydraulic energy within the pressurized drilling fluid 26 is converted to mechanical rotational energy and transferred to the drill bit 110 via the powered rotary steering system 140.

The direction in which the drill bit 110 bores the wellbore 11 may be controlled via the directional system 121. The directional system may impart forces on the walls of wellbore 11. Imparting forces on the wellbore may cause deflection of the drill bit 110 such that the drill bit 110 changes the direction in which it is boring the wellbore 11.

Telemetry information, for example, rate of penetration, orientation, and azimuth of the drill bit may be measured via the telemetry system 120. The telemetry system 120 may include a drilling dynamics measuring unit. A drilling dynamics measuring unit includes one or more accelerometers, for example, a three axis accelerometer and one or more gyros, for example, a three axis gyro, to measure acceleration and rotation of the bottom hole assembly 100 in three dimensions. A drilling dynamics measuring unit may also include one or more magnetometers to measure the magnetic field at the bottomhole assembly 100. The telemetry information may be transmitted to a controller, for example, controller 174, wherein the telemetry data is processed to determine the direction and orientation of the downhole end of the bottomhole assembly 100, in particular, of the drill bit 110. The controller 174 may then compare the location and orientation of the downhole end of the bottomhole assembly 100 with a desired location and orientation of the downhole end of the bottomhole assembly 100 and based on this comparison, issue commands to the directional system 121 to adjust or correct the direction and orientation in which the drill bit 110 bores the wellbore 11.

The telemetry information and drill bit correction commands may be transmitted between the telemetry system 120, the controller 174, and the directional system 121 via a multi-conductor communications bus 190. The multi-conductor communications bus 190 connects the various systems within the bottomhole assembly 100. The multi-conductor communications bus 190 may include conductors that facilitate high-speed, fault tolerant communication between the various systems within the bottomhole assembly 100 and may also include conductors that facilitate the transfer of electrical energy between the systems within the bottomhole assembly 100.

The conductors that carry the electrical energy may differ from the conductors that carry the communication signals. The conductors that carry the electrical energy may have a greater diameter, or lower gauge, as compared to the conductors that carry the communication signals. The conductors that carry electrical energy may also have increased insulation to aid in preventing short-circuits as compared to the conductors that carry the communication signals.

The downhole end of the bottomhole assembly 100 may also include a drilling mechanics module 130. The drilling mechanics module 130 may include one or more strain gauges and load cells for measuring the torque on the drill bit 110 and the weight on the drill bit 110, respectively. The drilling mechanics module 130 may measure dynamic information, such as axial forces and torsional forces, at the downhole end of the bottomhole assembly 100 and then transmit this information to other systems within the bottomhole assembly 100.

For example, in some embodiments, the dynamic information may be communicated to the controller 174 or to the powered rotary steering system 140. If the dynamic information is communicated to the controller 174, the controller 174 may use the information to control the operation of the powered rotary steering system 140 by issuing commands to a controller and telemetry system 142 within the powered rotary steering system 140. In some embodiments, wherein the dynamic information is transmitted directly to the powered rotary steering system 140, the controller and telemetry system 142 within the powered rotary steering system 140 may use the information to directly control the operation of the powered rotary steering system 140. In some embodiments, the telemetry and control system 142 may include a drilling dynamics measuring unit and may use measurements from the drilling dynamics unit in combination with the information from the drilling mechanics module to control operation of the drill bit 110.

Moving further uphole, a stabilizer 180 is located in the drill string between the powered rotary steering system 140 and the logging while drilling system 150. The stabilizer 180 aids in stabilizing the bottomhole assembly 100 within the wellbore 11 during operation. For example, the stabilizer 180 may have a larger outside diameter than the outside diameter of the bottomhole assembly 100. The larger diameter of the stabilizer 180 may more closely match the diameter of the wellbore 11. By more closely matching the diameter of the wellbore, the stabilizer 180 aids in keeping the bottomhole assembly centered within the wellbore 11. The stabilizer 180 may also include a drilling dynamics measurement unit in communication with other portions of the bottomhole assembly 100.

A logging while drilling system 150 may also be located in the bottomhole assembly 100. In the embodiment shown in FIG. 2, the logging while drilling system 150 is located uphole of the stabilizer 180. The logging while drilling system 150 may include one or more systems. For example, the logging while drilling system 150 includes five systems, an acoustic system 151, a dielectric system 152, a geo-steering system 153, a density system 154, and a drilling dynamics measurement unit 155. The logging while drilling system 150 may also include systems that measure resistivity and porosity of the formation surrounding the wellbore 11. In some embodiments, other systems within the drilling while logging system 150 may include imaging systems such as a nuclear magnetic resonance imaging system, and other logging while drilling systems.

The logging while drilling system 150, through its various systems, measures the properties of the formation surrounding the bottomhole assembly 100 and may also measure dynamic information related to the position, orientation, and movement of the bottomhole assembly 100.

An energy storage system 160 may be located in the bottomhole assembly 100 uphole of the logging while drilling system 150. The energy storage system 160 may include one or more batteries 162 and a controller and measurement unit 164. The batteries 162 may supply electrical energy to the various other systems within the bottomhole assembly 100. The electrical energy stored within the batteries 162 may be carried by one or more conductors within the multi-conductor communications bus 190. The batteries 162 may allow the various systems of the bottomhole assembly 100 to operate during periods when drilling fluid is not flowing through the bottomhole assembly 100.

The controller and measurement unit 164 of the energy storage system may control the charging, storage, discharge, and distribution of energy between the energy storage system 160 and the various other systems within the bottomhole assembly 100. The controller and measurement unit 164 may also measure the dynamic and mechanical forces and movement of the bottomhole assembly 100. For example, in some embodiments, the controller and measurement unit 164 may include a drilling dynamics measurement unit and may also include a drilling mechanics module or additional systems such as those described above with respect to the logging while drilling system 150. The controller and measurement unit 164 may transmit the information gathered by the energy storage system to one or more of the other systems within the bottomhole assembly 100. For example, data from a drilling mechanics module within the energy storage system 160 may be transmitted to the controller 174 or the powered rotary steering system 140.

The bottomhole assembly 100 may also include a computing system 170. The computing system 170 may include a measurement system 173, an energy converting system 171, and the controller 174. The measurement system 173 may include a drilling dynamics measurement unit and may also include a drilling mechanics module or additional systems such as those described above with respect to the logging while drilling system 150. Measurement system 173 may transmit the information gathered by the computing system 170 to one or more of the other systems within the bottomhole assembly 100.

The energy converting system 171 converts the hydraulic energy in the drilling fluid 26 into electrical energy to power the various systems of the bottomhole assembly 100 and for storage within the energy storage system 160. The energy converting system 171 may generate electrical energy via a turbine connected to an electrical generator. As drilling fluid 26 flows through the turbine within the energy converting system 171, the hydraulic energy in the drilling fluid is converted to rotational mechanical energy in the turbine. The turbine may be connected via a shaft to the generator, which then converts the rotational mechanical energy into electrical energy.

The controller 174 may control the operation of the energy converting system 171 and the measurement system 173 within the computing system 170. In addition, the controller 174 may also receive information from and control the operation of the various systems within the bottomhole assembly 100. For example, the controller may receive information, including shock and vibration data from the drilling dynamics units located within the systems of the bottomhole assembly 100, for example, the drilling mechanics module 130, and the logging while drilling system 150, and then use that information to determine the dynamics state of the bottomhole assembly 100, for example, via computational processes and algorithms, including the shock and vibration modes to which the bottomhole assembly 100 is being subjected.

Some shock and vibration modes can lead to damage and premature failing of the bottomhole assembly 100. Therefore, after determining the shock and vibration modes to which the bottomhole assembly 100 is being subjected, the controller 174 may issue commands to the various systems within the bottomhole assembly 100 to change the operation of the bottomhole assembly 100. For example, the controller may send commands to actuators, such as the powered rotary steering system 140, or other actuators in the bottomhole assembly along with the other drilling systems, including the drilling rig 15 to mitigate potential damage to the bottomhole assembly 100. Actuators may also include stabilizers, adjustable reamers, clutches, thrusters, shock subs, and flow controls.

The multi-conductor communications bus 190 within the bottomhole assembly 100 aids in transmitting the data and commands between the various systems in the separate sections of the bottomhole assembly 100 in real time. By transmitting the data and commands between the separate sections of the bottomhole assembly 100 in real time, the bottomhole assembly 100 may react quickly to reduce potential damage due to shock and vibration as compared to sending information uphole for processing by the computer processor 85 and displayed by the GUI 92 to an operator who may then issue commands that would be sent back downhole to the bottomhole assembly 100 for execution or as compared to a bottomhole assembly 100 that does not have a multi conductor communication bus 190 that connects the sections of the bottom hole assembly in electronic communication. The delay in sending information uphole for evaluation by an operator may be several seconds to several minutes during which time the bottomhole assembly 100 may be subjected to damaging shocks and vibrations.

Real time communication and calculations includes communication, calculations, and computations that occur at very high speed with low latency such that high frequency events and behaviors can be observed simultaneously in along the bottomhole assembly 100 and responded to.

The controller 174 may also send information to and receive information from the surface via the uphole communication system 105. In the embodiment shown in FIG. 2, the uphole communication system includes a mud pulse modulator 106. The energy converting system 171, for example, a turbine generator, receives information from uphole by measuring the change in flow of the drilling fluid 26 within the drill string 12. The mud pulse modulator 106 transmits information up the hole by causing variations in the pressure of the drilling fluid 26 within the drill string 12. Other uphole communication systems are described below with reference to FIGS. 3 and 4.

The controller 174 may also include data storage and recording systems that store and record measurements and other information collected by the controller 174 from the various systems and the bottomhole assembly 100.

The bottomhole assembly 100 may be connected to the rest of the drill string 12 via a crossover, not shown, above the uphole communication system 105.

As described above, shocks and vibrations cause many problems in the drilling environment. Shock in the drilling environment is the sudden input of energy caused by impact of the drill bit 110, the bottomhole assembly 100, or the drill pipe with the wellbore 11. Vibrations can result from these shocks. Rapid and continuous vibrations can result in fatigue and breaking of the drill string 12 and with failure of the various bottomhole assembly 100 drilling and measurements systems.

Shocks are measured by an accelerometer and can sometimes exceed several hundred Gs. The severity of the shock can depends on the magnitude of the force of the shock, the duration of the shock, and the frequency or number of shocks.

The shocks imparted on the drill string 12 and the rotation of the drill bit 110 and on the drill string 12 cause the vibrations within the drill string 12. The shocks and vibrations can take on seven modes: an axial mode, a lateral mode, a torsional mode, a forward whirl mode, backward while mode, a chaotic whirl mode, and a stick-slip mode. The shock and vibration characteristics of the bottomhole assembly 100 may be a combination of one or more of the seven modes.

Axial shocks are shocks with a directional force that are along an axis of the drill string 12. Axial shocks may result in what is sometimes called bit bounce wherein the drill bit 110 excites various modes of resonance in the drill string and BHA due to lobes formed in the bottom of the wellbore 11. These modes are mostly seen with roller cone type bits. In some modes, the axial shocks cause variations in the weight on the drill bit 110 over time but do not cause bit bounce.

Lateral shocks are shocks with a direction of force that is perpendicular to the drill string 12 axis. Lateral shocks may be caused by the bottomhole assembly 100 or the drill pipe impacting the sidewalls of the wellbore 11.

Torsional shocks result from the momentary slowing down or stopping of the drill string, such as in stick-slip vibration events, described below. A torsional shock may occur when the bit or stabilizer digs into the formation deeply enough to slow it down relative to the drill string 12. This causes a winding effect in the drill string 12, wherein the energy that would otherwise be imparted by the drill bit 110 into the formation 30 is instead stored in the twisting of the drill string 12. When the stored energy overcomes the resistance of the drill bit 110 against the formation 30 the stored energy is released. Both the storage and release of the energy in the drill string 12 result in tortional shock to the drill string 12 and the components in the drill string 12, including the systems within the bottomhole assembly 110, which may lead to premature failure.

Whirl may be caused by an under stabilized drill string 12 and forces acting upon the drill string 12, such as rotating close to a resonant frequency of the drill string 12 or operating in a large or enlarged wellbore 11. Whirl occurs when part of the drill string 12, such as a drill string collar, contacts the wall of the wellbore 11 while rotating. There are three main types of whirl: forward whirl, backward whirl, and chaotic whirl.

Forward whirl occurs when the bottomhole assembly 100 contacts and rubs the formation 30 on the same side of the drill string 12 as the drill string 12 rotates. This may cause excessive wear to the drill string 12 at the location that rubs against the wellbore 11 and may cause flat spots on the drill string 12. In forward whirl the drill string 12 rotates eccentrically within the wellbore 11 in the same direction as the drill bit 110.

Backward whirl is similar to forward whirl except the drill string 12 rotates eccentrically within the wellbore 12 in a direction opposite the drill bit 110. In backward whirl the contact location of the drill string 12 with the wellbore 11 rotates around the drill string 12 causing a variable bending moment in the drill string 12. Backward whirl may cause increased fatigue and accelerated failure of components of drill string 12 as compared to forward whirl.

In chaotic whirl, there is no preferential side of the drill string 12 that contacts the formation 30. Chaotic whirl may be characterized by increased lateral shocks and may, for example, occur when attempting to change the rotational speed of the drill string 12 to address forward whirl and backward whirl modes.

Stick-slip is the non-uniform rotation of the drill string 12 and may be characterized by the rotational slowing down and speeding up of the bottomhole assembly 100. In some embodiments, the bottomhole assembly 100 may come to a complete stop or even reverse direction. The stick effect is caused by an increase in friction of the drill bit 110 with the formation 30 causing a momentary slowing down or stopping of the bottomhole assembly 100. As this happens, the drill string 12 stores the energy imparted by the rotary table 16 or topdrive of the drilling rig 15. This energy builds up until the energy overcomes the friction that is slowing down or stopping the drill bit 110. When the stored energy is released, the bottomhole assembly 110 accelerates to catch up with the rotary table 16 and results in an increase in the bottomhole assembly 100 rotational speed. The rotation of the bottomhole assembly 100 may overtake the rotation of the rotary table 16 and wind up the drill string 12 in the opposite direction, which may cause the drill bit 110 to rotate backward until the drill bit 110 again matches the rotation of the rotary table 16.

As discussed above, shocks and vibrations can cause damage and premature failure of the bottomhole assembly 100 or the drill string 12. Shocks and vibrations can also adversely affect the rate of penetration during the drilling process because energy expended due to shock and vibration is not transmitted to the drilling bit 110 and into the formation 30, and may thereby slow the drilling of the wellbore 11. Therefore, real time identification and mitigation of potentially harmful shock and vibration modes in the bottomhole assembly 100 may aid in preventing damage to the bottomhole assembly 100 and the drill string 12 and may also facilitate increased rate of penetration of the drill string 12.

After determining the shock and vibration modes along the length of the bottomhole assembly 100, a controller within the bottomhole assembly 100, such as the controller 174 within the computing system 170, can then issue commands to other systems within the bottomhole assembly 100. For example, the controller 174 may issue commands to the powered rotary steering system 140 and other actuators in the bottomhole assembly 100 to change the shock and vibration mode or reduce the magnitude of the shock and vibration of the bottomhole assembly 100. The other actuators may include adjustable reamers and stabilizers, actuators that control the flow of a mud motor, clutches or other flow controls and actuators in the bottomhole assembly 100. The controller 174 may also communicate with uphole equipment via the uphole communication system 105 to, for example, control the speed of the rotary table 16 of the drilling rig 15. As part of, for example, a computational process, bottom hole assembly 100 displacements, vibration nodes/antinodes can be compressed by the computing system 170 and sent uphole where snapshot images of the bottomhole assembly 100 can be reconstructed at the surface as part of the overall interpretation and analysis of the bottomhole assembly 100 behavior.

After determining the shock and vibration modes along the length of the bottomhole assembly 100, a controller within the bottomhole assembly 100, such as the controller 174 within the computing system 170, can then issue commands to other systems within the bottomhole assembly 100. For example, the controller 174 may issue commands to the powered rotary steering system 140 to adjust the rotational speed of the drill bit 110, adjust the weight on the drill bit 110, and/or adjust the torque on the drill bit 110 to change the shock and vibration mode or reduce the magnitude of the shock and vibration of the bottomhole assembly 100. The controller 174 may also communicate with uphole equipment via the uphole communication system 105 to, for example, control the speed of the rotary table 16 of the drilling rig 15.

Figure 3:
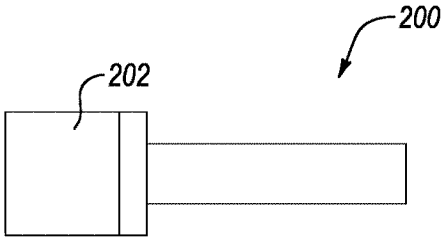
FIG. 3 depicts a communication system according to one or more embodiments disclosed herein.

FIG. 3 shows an embodiment of an uphole communication system 200 that includes an electromagnetic telemetry communication system 202. The electromagnetic telemetry communication system transmits data by generating a voltage difference across an insulator, sometimes called a gap sub, between the bottomhole assembly 100 and the rest of the drill string 12.

Figure 4:
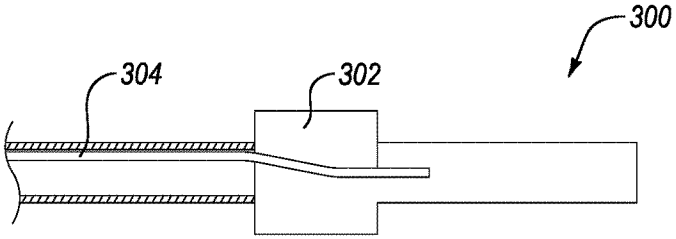
FIG. 4 depicts a communication system according to one or more embodiments disclosed herein.

FIG. 4 shows an embodiment of an uphole communication system 300 that includes a wired drill pipe system 302 that further includes a communication bus 304 along the drill pipe of the drill string 12 for communicating uphole. The uphole communication system 300 transmits data uphole by sending electronic signals through the communication bus 304.

Figure 5:
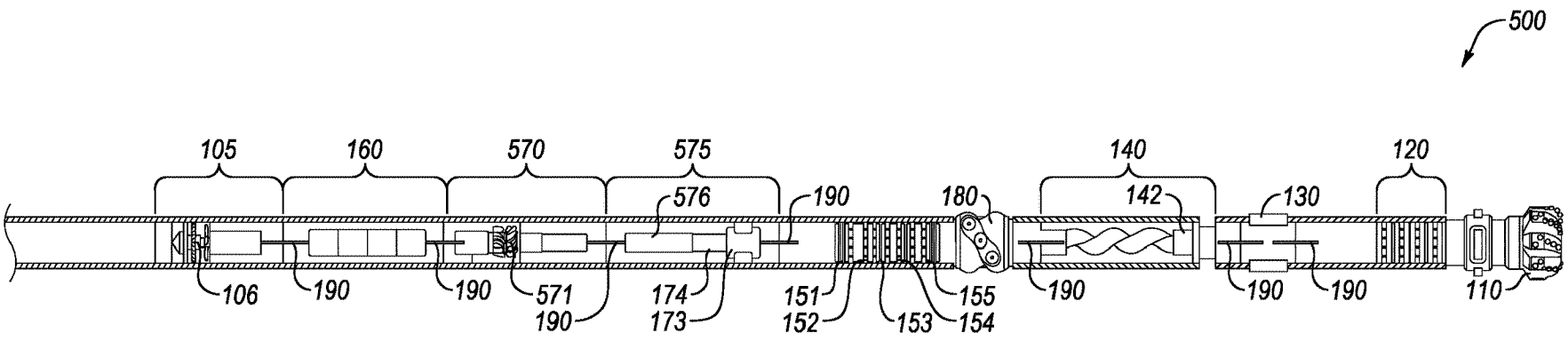
FIG. 5 depicts a bottomhole assembly string according to one or more embodiments disclosed herein.

FIG. 5 depicts an embodiment of a bottomhole assembly 500. Similar numerical indicators in FIG. 5 correspond to the same numerical indicators in FIG. 1 and therefore the features in FIG. 5 that are similar to FIG. 1 are not discussed. The bottomhole assembly 500 is reconfigured uphole of the logging while drilling system 150 as compared to the bottomhole assembly 100 depicted in FIG. 1.

The bottomhole assembly 500 includes a computing system 575. The computing system 575 may include a controller 174 and a measurement system 173. In addition, the computing system 575 may include a separate data storage and recording system 576 that stores and records measurements and other information collected by the controller 174 from the various systems in the bottomhole assembly 500.

The bottomhole assembly 500 may include a discrete energy converting system 570 that includes an energy converter 571 that converts the hydraulic energy in the drilling fluid 26 into electrical energy to power the various systems of the bottomhole assembly 100 for storage within the energy storage system 160. The energy converter 571 may generate electrical energy via a turbine connected to an electrical generator. As drilling fluid 26 flows through the turbine within the energy converter 571, the hydraulic energy in the drilling fluid is converted to rotational mechanical energy in the turbine. The turbine may be connected via a shaft to the generator, which then converts the rotational mechanical energy into electrical energy. The discrete energy converting system 570 may include a controller for controlling the energy converter 571.

The bottomhole assembly 500 may also include an energy storage system 160 located between the discrete energy converting system 570 and the uphole communication system 105.

A few example embodiments have been described in detail above; however, those skilled in the art will readily appreciate that many modifications are possible in the example embodiments without materially departing from the scope of the present disclosure or the appended claims. Accordingly, such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination. In addition, other embodiments of the present disclosure may also be devised which lie within the scope of the disclosure and the appended claims. Additions, deletions and modifications to the embodiments that fall within the meaning and scopes of the claims are to be embraced by the claims.

Certain embodiments and features may have been described using a set of numerical upper limits and a set of numerical lower limits. It should be appreciated that ranges including the combination of any two values, e.g., the combination of any lower value with any upper value, the combination of any two lower values, or the combination of any two upper values are contemplated. Certain lower limits, upper limits and ranges may appear in one or more claims below. Numerical values are "about" or "approximately" the indicated value, and take into account experimental error, tolerances in manufacturing or operational processes, and other variations that would be expected by a person having ordinary skill in the art.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include other possible embodiments along with the full scope of equivalents to which such claims are entitled. Accordingly, the claims are not limited by the disclosure.

The invention claimed is:

1. A system for measurement and control of shock and vibration, comprising:

a bottomhole assembly having a downhole end and an uphole end opposite the downhole end and a plurality of distinct sections releaseably coupled together;

a drill bit located in a first of the plurality of distinct sections of the bottomhole assembly;

a powered rotary steering system located in the bottomhole assembly;

a first drilling mechanics module located at a first location in the bottomhole assembly proximate the powered rotary steering system and the drill bit, and coupled in electronic communication to the power rotary steering system, the first drilling mechanics module including at least one strain gauge configured to measure a torque on the drill bit or at least one load cell configured to measure an axial force on the drill bit; and a plurality of drilling dynamics measurement units distributed along a length of the bottomhole assembly between the downhole end and the uphole end and coupled in electronic communication with the first drilling mechanics module, each of the plurality of drilling dynamics measurement units being located in a respective one of the plurality of distinct sections, each of the plurality of drilling dynamics measurement units including at least one accelerometer configured to measure an acceleration of the bottomhole assembly and at least one gyro configured to measure a rotation of the bottomhole assembly.

2. The system of claim 1, further comprising a controller located in the bottomhole assembly, the controller coupled to the first drilling mechanics module and coupled to the plurality of drilling dynamics measurement units via a multi conductor communication bus.

3. The system of claim 2, wherein the controller is configured to receive measurement information from the first drilling mechanics module and the plurality of drilling dynamics measurement units and to determine a dynamic state of the bottomhole assembly in real time.

4. The system of claim 3, wherein the dynamic state of the bottomhole assembly includes displacements of the bottomhole assembly along the length of the bottomhole assembly, the axial force on the drill bit, and the torque on the drill bit.

5. The system of claim 3, wherein the controller is configured to determine a vibration mode of the bottomhole assembly.

6. The system of claim 3, wherein the controller is configured to adjust the operation of the bottomhole assembly based on the dynamic state of the bottomhole assembly in real time.

7. The system of claim 1, wherein the first drilling mechanics module includes at least one strain gauge configured to measure a torque on the drill bit and at least one load cell configured to measure an axial force on the drill bit.

8. The system of claim 1, further comprising second and third drilling mechanics modules deployed at corresponding second and third distinct locations in the bottomhole assembly, each of the second and third drilling mechanics modules including at least one strain gauge configured to measure a torque on the drill bit or at least one load cell configured to measure an axial force on the drill bit, the second and third locations being different than the first location.

9. The system of claim 1, wherein each of the plurality of drilling dynamics measurement units includes at least one three-axis accelerometer configured to measure three dimensional acceleration of the bottomhole assembly and at least one three-axis gyro configured to measure three dimensional rotation of the bottomhole assembly.

10. The system of claim 1, wherein a first of the plurality of drilling dynamics measurement units is deployed downhole from the powered rotary steering system, a second of the plurality of drilling dynamics measurement units is deployed in the powered rotary steering system, and a third of the plurality of drilling dynamics measurement units is deployed uphole from the powered rotary steering system.

11. A method of measuring and controlling shock and vibration, comprising:

receiving first measurements of mechanical behavior of a bottomhole assembly from a first drilling mechanics module located in a first of a plurality of distinct sections of the bottomhole assembly by a controller located in the bottomhole assembly, a drill bit located at a downhole end of the bottomhole assembly, the first measurements including at least one of a torque on the drill bit or an axial force on the drill bit;

receiving second measurements of mechanical behavior of a bottomhole assembly from a plurality of drilling dynamics measurement units distributed in the plurality of distinct sections of the bottomhole assembly along a length of the bottomhole assembly, the second measurements including acceleration and rotation of the bottomhole assembly; and controlling the drill bit by the controller via a powered rotary steering system based on the first measurements of mechanical behavior and the second measurements of mechanical behavior.

12. The method of claim 11, further comprising:

determining a dynamic state of the bottomhole assembly based on the first measurements of mechanical behavior and the second measurements of mechanical behavior of the bottomhole assembly.

13. The method of claim 12, wherein receiving first measurements of mechanical behavior of the bottomhole assembly from the first drilling mechanics module by the controller located in the bottomhole assembly includes communicating the first measurements of mechanical behavior between the first drilling mechanics module and the controller over a multi-conductor communication bus.

14. The method of claim 12, wherein determining the dynamic state of the bottomhole assembly includes determining a vibration mode of the bottomhole assembly.

15. The method of claim 11, wherein controlling the drill bit includes adjusting the flow through a mud motor.

16. The method of claim 11, wherein controlling the drill bit includes adjusting an adjustable stabilizer.

17. The method of claim 11, wherein controlling the drill bit includes adjusting an adjustable reamer.

* * * * *